US006709016B2

(12) United States Patent
Duschek et al.

(10) Patent No.: US 6,709,016 B2
(45) Date of Patent: Mar. 23, 2004

(54) METHOD AND DEVICE FOR THE PRODUCTION OF SECURITY ELEMENTS FOR ELECTRONIC ARTICLE SURVEILLANCE AND CORRESPONDING SECURITY ELEMENT

(76) Inventors: Detlef Duschek, Grünesgasse 5, D-64759 Sensbachtal (DE); Gordon Klassen, 2541 E. Markwood St., Duarte, CA (US) 91010

( * ) Notice: Subject to any disclaimer, the term of this patent is extended or adjusted under 35 U.S.C. 154(b) by 0 days.

(21) Appl. No.: 10/194,286

(22) Filed: Jul. 15, 2002

(65) Prior Publication Data

US 2003/0053889 A1 Mar. 20, 2003

Related U.S. Application Data

(62) Division of application No. 09/423,871, filed as application No. PCT/EP98/02544 on Apr. 30, 1998, now Pat. No. 6,494,660.

(30) Foreign Application Priority Data

May 15, 1997 (DE) ..... 197 20 319

(51) Int. Cl.[7] ..... B42D 15/00

(52) U.S. Cl. ..... 283/67; 412/9; 282/81; 282/82; 428/900

(58) Field of Search ..... 283/81, 80, 79, 283/101, 105, 82, 83, 67; 412/1, 8, 37, 900, 9; 340/572.1, 572.3, 572.6; 156/297; 428/900

(56) References Cited

U.S. PATENT DOCUMENTS

| | | | | |
|---|---|---|---|---|
| 5,246,522 A | | 9/1993 | Cordery et al. | |
| 5,355,120 A | | 10/1994 | Ferguson et al. | |
| 5,406,264 A | * | 4/1995 | Plonsky et al. | 340/572 |
| 5,602,528 A | | 2/1997 | Witchger | |
| 5,921,583 A | * | 7/1999 | Matsumoto et al. | 283/81 |

FOREIGN PATENT DOCUMENTS

| | | |
|---|---|---|
| DE | 3244430 A1 | 11/1984 |
| EP | 0319248 A2 | 6/1989 |
| EP | 0737949 A1 | 10/1996 |

* cited by examiner

*Primary Examiner*—Willmon Fridie, Jr.
(74) *Attorney, Agent, or Firm*—Bacon & Thomas, PLLC

(57) ABSTRACT

The present invention is directed to a method and a device for the production of security elements for electronic article surveillance, the security elements being comprised of at least two layers, as well as to a web material manufactured by means of the method the present invention proposes a simple, economical method, a corresponding device for the production of web material, as well as to a web material manufactured by the method for the purpose of electronic article surveillance. With regard to the method of the present invention, it is accomplished in that sections of a predetermined length cut from a second material web are conveyed in a direction transverse to the running direction of a first continuous material web and are applied to the first material web.

10 Claims, 3 Drawing Sheets

METHOD AND DEVICE FOR THE PRODUCTION OF SECURITY ELEMENTS FOR ELECTRONIC ARTICLE SURVEILLANCE AND CORRESPONDING SECURITY ELEMENT

This application is a division of Ser. No. 09/423,871 filed Nov. 15,1999 now U.S. Pat. No. 6,494,660, which is the National Stage of PCT/EP98/02544, filed Apr. 30, 1998.

FIELD OF THE INVENTION

This invention relates to a method and a device for the production of security elements for electronic article surveillance as well as to a corresponding security element, one security element being comprised of at least two layers.

BACKGROUND OF THE INVENTION

The goods in department stores and warehouses are being protected from theft increasingly by electronic devices. One way to guard against theft by electronic surveillance is to attach strip elements, meaning elongate soft magnetic pieces of metal (e.g., VITROVAC from the Vacuumschmelze company), to the goods. These strip elements trigger an alarm when present in corresponding monitoring systems, which are usually positioned in the exit area of the facility to be protected.

A Electronic article surveillance can be described roughly as follows: A monitoring system has a transmitting device and a receiving device. The transmitting device transmits an interrogating signal into a monitoring zone. This interrogating signal excites the strip element into transmitting a reply signal which is detected and identified by the receiving device the occurrence of a reply signal is equated with the unauthorized passing of an.

Resonant security elements are used in addition to the strip-shaped security elements for electromagnetic article surveillance. These resonant security elements are comprised of a resonant circuit having a capacitive and induction elements. As soon as such a resonant circuit is exposed to a corresponding electromagnetic field inside an interrogation zone it transmits a reply signal with its resonant frequency.

SUMMARY OF THE INVENTION

It is an object of the present invention to provide a simple, economical method, a corresponding device and a web material manufactured by the method for the purposes of electronic article surveillance.

The object of the present invention with regard to the method is accomplished in that sections of a second web material cut to a predetermined length are conveyed in a direction transverse to the running direction of a first continuous material web and are applied to the first material web. An application example of web materials produced in this manner follows below.

The previously mentioned strip elements for electronic article surveillance come in a length of several centimeters (e.g., 3 cm). Labels, each containing one strip element, are conventionally provided in the form of a roll of labels and dispensed by means of suitable dispensing devices. If—as is usual—the strip elements measuring several centimeters in length are wound up in the longitudinal direction to a roll of labels, one roll of labels will contain relatively few labels. The picture is quite different, however, if the strip elements are wound up in the transverse direction to the dispensing direction. It is then possible to materially increase the number of strip elements per roll of labels.

The transverse arrangement of the strip elements affords particular advantages when it is considered how these strip elements are normally produced: A relatively wide soft magnetic endless strip is produced; this endless strip is subsequently split into several soft magnetic endless strips lying in side-by-side arrangement. A label applied from the side to the first material web thus contains several parallel strip elements. This way it is possible to achieve a further notable reduction in the production costs for label rolls containing strip elements.

According to a further application example, sections cut from a thin-film material are applied to an endless strip made of thin-film material (materials of this type are described in detail in European Patent EP 0 295 028). For production-related reasons, thin-film materials display a preferential direction, i.e., the reply signal is at its maximum level when the interrogation field is oriented parallel to this preferential direction but is at zero level when the angle of incidence is perpendicular to the preferential direction. If two layers of thin-film materials are arranged perpendicular to each other, the security element in question will always be excited into transmitting a reply signal regardless of its orientation in the interrogation zone.

The method of the present invention is characterized in that according to an advantageous further aspect the sections of predetermined length cut from the second material web can be applied to the first material web in steps or continuously. The advantage of the continuous method is, of course, the higher production rate.

The object of the present invention with regard to the device is accomplished in that a guide device is provided for a first material web, at least one dispensing device for feeding the sections of a predetermined length cut from a second material web is provided at right angles to the guide device, and a conveying device is provided to take successively from the dispensing device those sections of predetermined length cut from the second material web and affix them to the first material web either directly, side-by-side, or with a gap in between.

While in use of just a single dispensing device the sections are applied to the first material web in steps with two or more dispensing device, it is possible for the device of the present invention to work continuously. All that is necessary in this case is for there to be a certain distance between each of the n dispensing devices and for the sections to be fed at a rate coordinated with the running speed of the first material web. The rate at which the sections are fed has to be set at least high enough for a section to be in the correct "ready" position as soon as that area of the first material web is reached where the section is to be applied.

According to an advantageous further aspect of the device of the present invention, provision is made for the dispensing device to be a conveyor belt, for at least one electromagnet to be positioned in the inner space formed by the revolving conveyor belt, for at least one further electromagnet to be provided in the area underneath the first material web where the sections of the second material web are to be applied to the first material web, and for a control/regulating unit to be provided to switch the electromagnets on and off so that the sections of the second material web are applied to the first material web.

Furthermore, in accordance with a favorable embodiment of the device of the present invention the following is proposed: A stop or a sensor for detecting the correct position of the section of the second material, web relative to the first material web is arranged in the end zone of the conveying device; the control/regulating unit switches the first electromagnet off and the second electromagnet on as soon as the stop or the sensor signals that the section of predetermined length cut from the second material web has reached the predetermined position relative to the first material web.

According to an advantageous further aspect of the device of the present invention, provision is made for n dispensing devices arranged at a relative distance of(2n+1)*(b+z), where b is the width of the sections of the second material web, and z the desired distance between two consecutive sections of the second material web. This embodiment permits the n dispensing devices to work parallel to each other, i.e., without time off-set. Obviously, the control effort is thus reduced considerably.

The advantages of a further aspect of the device of the present invention, which involve the setting of the running speed of the first material web so that the sections of predetermined length of the second material web are applied to the first material web in a continuous process, have already been mentioned in the foregoing.

Advantageously, provision is made for a take-up reel onto which the finished web material is wound.

The object of the present invention with regard to the security element is accomplished in that the first material web is a continuous material web to which the sections of a predetermined length cut from a second material web made of a magnetic material are conveyed in a direction transverse to the running direction (x) of the first material web and applied thereto.

Preferably, the first material web is a substrate; and sections of a predetermined length cut from the second material web are adhesive labels, each containing at least one security element for electronic article surveillance.

Alternatively, the security elements are a plurality of deactivatable or non-deactivatable strip elements arranged parallel to each other and in a direction transverse to the running direction (x) of the first material web.

A further embodiment of the security element of the present invention provides for the first material web to be a thin-film material whose preferential direction extends transverse or parallel to the running direction (x) of the first material web, and for the sections of predetermined length (1) cut from the second material web to be equally thin-film labels whose preferential direction extends respectively parallel or transverse to the running direction (x) of the first material web.

Similarly, it is possible for the sections of a predetermined length cut from the second H material web to be resonant labels.

BRIEF DESCRIPTION OF THE DRAWINGS

The present invention will be explained in more detail in the following with reference to the accompanying drawing. In the drawings.

DESCRIPTION OF THE PREFERRED EMBODIMENT

Figure 1:
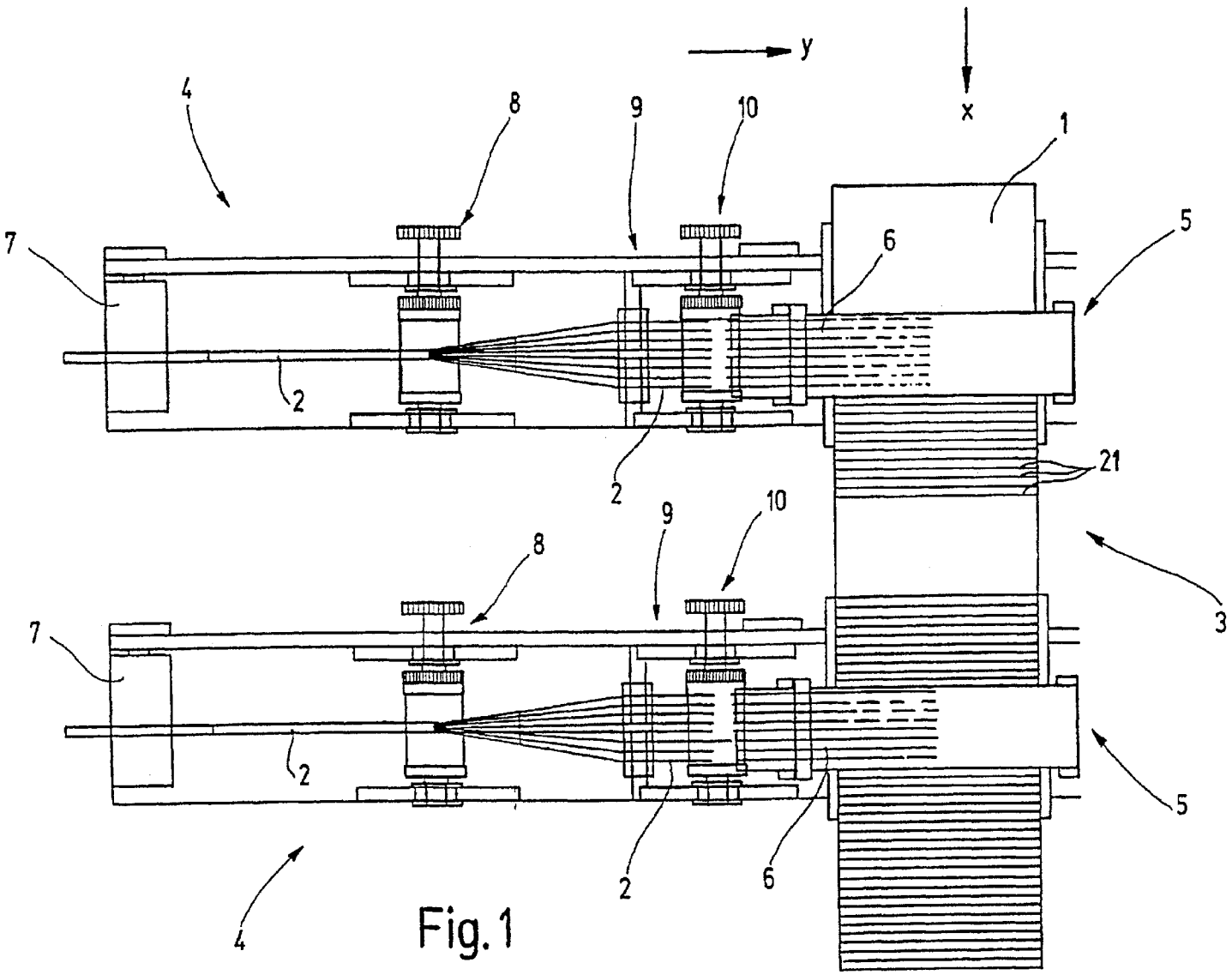
FIG. 1 is a top plan view of an embodiment of the device of the present invention.

FIG. 1 shows a top plan view of an embodiment of the device of the present invention.

Figure 2:
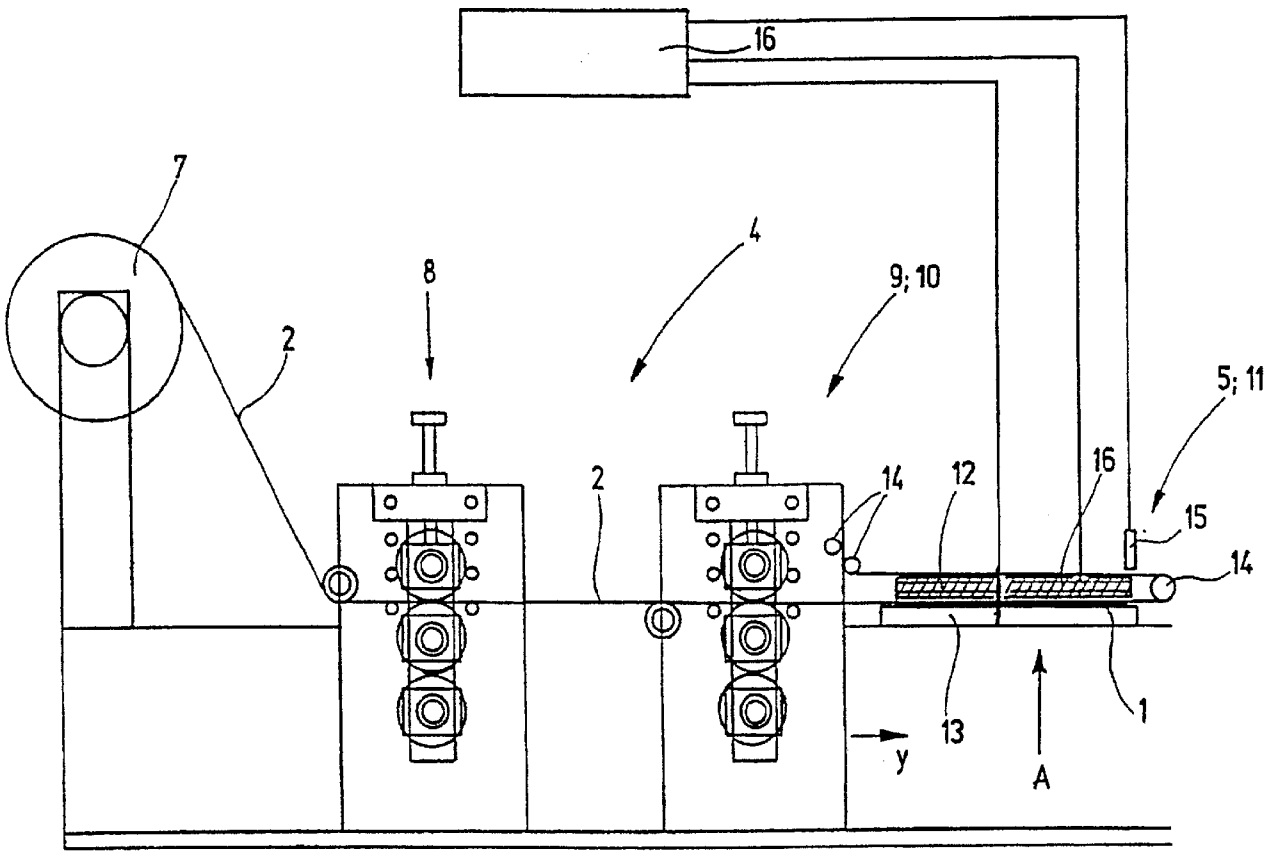
FIG. 2 is a longitudinal sectional view of the dispensing device of FIG. 1.
Figure 2A:
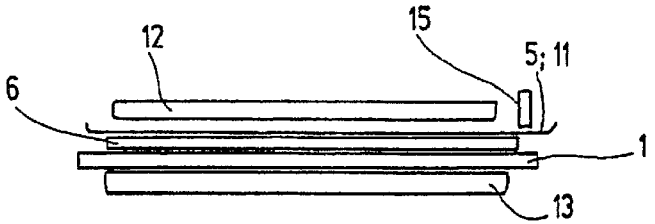
FIG. 2*a* is a view, to an enlarged scale, of detail A of FIG. 2.

FIG. 2 shows a longitudinal section of a conveying device 4 and a cross section of a guide device 3.

In the embodiment shown, a material web 2 is a soft magnetic strip from which elements referred to as strip elements for electronic article surveillance are made. The material web 2 is unwound from a supply reel 7 and divided in a longitudinal cutting unit 8 into strips of desired width. The web material 2, which has been divided into individual strips, is then fanned out in a fanning unit 9 so that the individual strips are a desired distance apart, after which they are cut in a cross cutting unit 10 into sections 6 of desired length (1). The adjacent lying soft magnetic strips of predetermined length (1) are picked up by a conveyor belt 11 and transferred over a cross-running material web 1. Feeding the sections 6 of strip elements over the material web 1 is performed by an electromagnet 12 (FIG. 2) arranged in the interior of the conveyor belt 11, which is guided around guide rollers 14. During this transfer cycle the electromagnet 12 is consequently activated. As soon as a section 6 with the strip elements has reached the correct position relative to the first material web 1—this information is received by a control/regulating unit 16 from a sensor 15—the control/regulating unit 16 switches off the electromagnet 12 and activates an electromagnet 13 arranged underneath the first material web 1. The sections 6 with strip elements are applied to the adhesive side of the material web 1 through the force of magnetic attraction. As soon as a section 6 with strip elements applied to the material web 1 is moved through underneath the dispensing device 4, the electromagnet 13 is switched off again.

Figure 3:
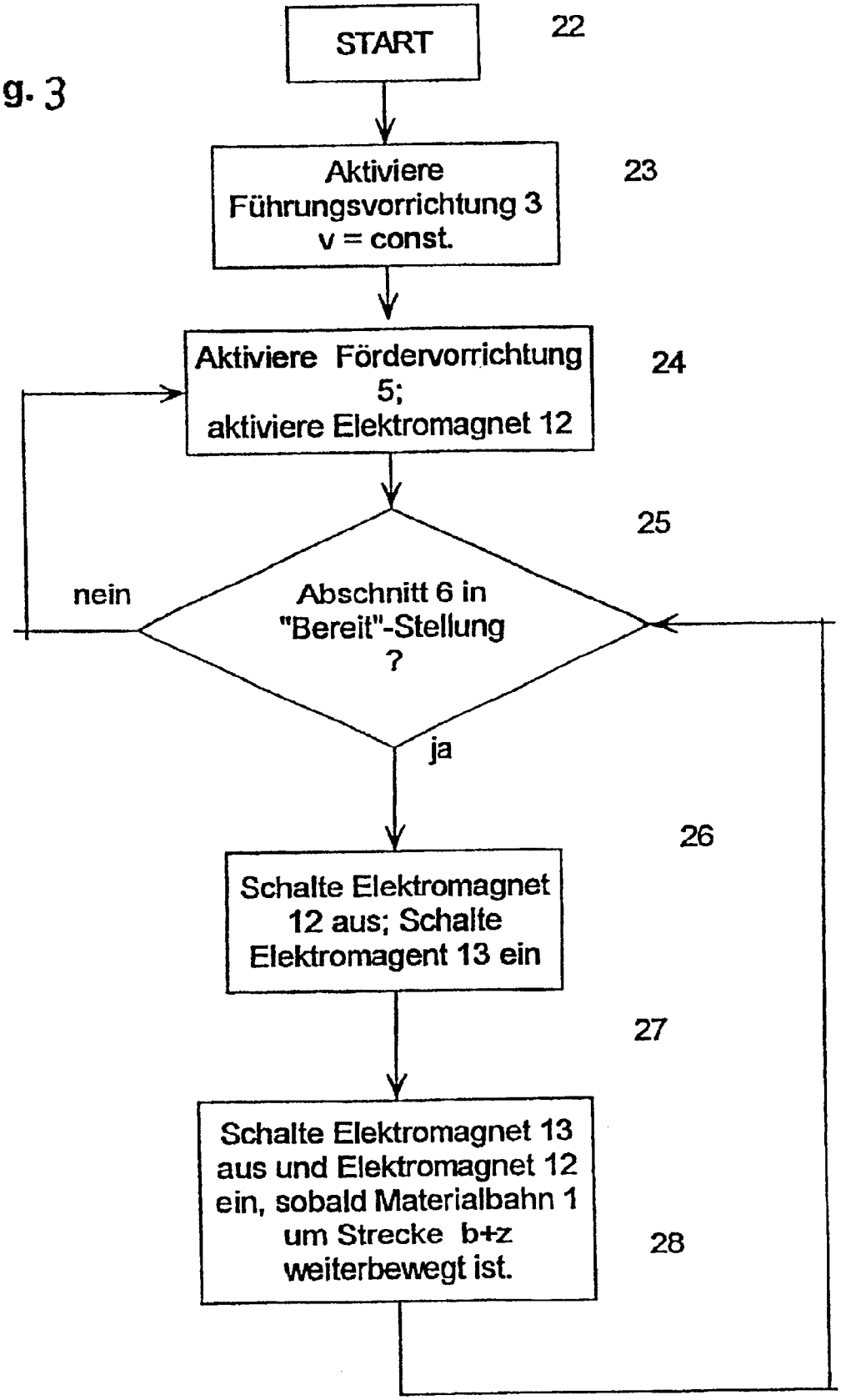
FIG. 3 is a flow diagram for controlling the control/regulating unit.

FIG. 3 shows a flow diagram for controlling the control/regulating unit 16. The program is started at 22. The guide device 3 for the first material web 1 is activated at program point 23. At the same time the conveying device 4 for feeding the sections 6 and the electromagnet 12 are activated. The electromagnet remains activated until the section 6 has reached the "ready" position, meaning the correct position relative to the material web 1. This check is performed at program point 25. As soon as the correct "ready" position of the section 6 is reached, the electromagnet 12 is switched off at program point 26 while the electromagnet 13 is switched on. The section 6 is applied by force of magnetic attraction to the adhesive side of the material web 1. The application operation is repeated in cycles as soon as the material web 1 is moved on a distance of at least 1+z.

List of references

1 first material web
2 second material web
3 guide device
4 dispensing device
5 conveying device
6 section
7 supply reel
8 longitudinal cutting unit
9 fanning unit
10 cross cutting unit
11 conveyor belt
12 electromagnet
13 electromagnet
14 guide roller
15 sensor
16 control/regulating unit
17 supply reel
18 adhesive device
20 web material
21 security element

What is claimed is:

1. A device for the production of security elements for electronic article surveillance, the security elements comprising at least two layers constructed from a first material web and a second material web, the device comprising:

a guide device for the first material web;

at least one dispensing device for feeding sections of a predetermined length cut from the second material web, said at least one dispensing device being arranged at right angles to said guide device; and at least one conveying device for taking the cut sections, successively, from said dispensing device and affix them to the first material web according to one of: side-by-side arrangement and with a gap arrangement, in a direction transverse to the first material web.

2. The device as defined in claim 1, further comprising:

at least one electromagnet;

at least one further electromagnet located in the area underneath the first material web; and a control/regulating unit, wherein:

said at least one dispensing device comprises a revolving conveyor belt, said revolving conveyor belt defining an inner space in which said at least one electromagnet is positioned; and said control/regulating unit serving to switch said at least one at east one electromagnet and said at least one further electromagnet on and off so that the cut sections are applied to the first material web.

3. The device as defined in claim 2, further comprising:

a sensor for detecting the correct position of the cut sections relative to the first material web, wherein:

said control/regulating unit switches said at least one electromagnet off and said at least one further electromagnet on as soon as said sensor signals that a cut section has reached the predetermined position relative to the first material web.

4. The device as defined in claim 1, wherein n dispensing devices are provided and arranged at a relative distance of (2n+1)*(b+z), where b is the width of a cut section and z the desired distance between consecutive cut sections.

5. The device as defined in claim 4, wherein said control/regulating device sets the running speed of the first material web in such a manner that the cut sections are applied to the first material web in a continuous process.

6. The device as defined in claim 1, further comprising:

a take-up reel onto which the finished web material is wound.

7. A web material with security elements for electronic article surveillance, comprising a first material web and a second material web made of a magnetic material, wherein said second material web includes cut sections of predetermined length which are applied to the first material web in a direction which is transverse to the running direction of said first material web, and wherein said first material web comprises a substrate and wherein said cut sections comprise adhesive labels each containing at least one security element.

8. The web as defined in claim 7, wherein said security elements comprises a plurality of one of: deactivatable and non-deactivatable strip elements arranged parallel to each other in a direction transverse to the running direction of said first material web.

9. The web as defined in claim 7, wherein said first material web comprises a thin-film material whose preferential direction extends transverse or parallel to the running direction of said first material web, and wherein said cut section comprises a thin-film label whose preferential direction extends respectively parallel or transverse to the running direction of said first material web.

10. The web as defined in claim 7, wherein said cut section comprises resonant labels.

* * * * *